US005934267A

United States Patent [19]

Briner

[11] Patent Number: 5,934,267

[45] Date of Patent: Aug. 10, 1999

[54] HEATED HAND GRIP FOR ARCHERY BOW

[76] Inventor: Scott M. Briner, 7553 Fisher Rd., Ontario, N.Y. 14519

[21] Appl. No.: 09/032,003

[22] Filed: Feb. 27, 1998

Related U.S. Application Data

[60] Provisional application No. 60/040,705, Mar. 14, 1997.

[51] Int. Cl.[6] ..... F41B 5/14

[52] U.S. Cl. ..... 124/88; 124/86

[58] Field of Search ..... 124/23.1, 80, 86, 124/88; 219/201

[56] References Cited

U.S. PATENT DOCUMENTS

| | | | |
|---|---|---|---|
| 744,739 | 11/1903 | Fliess . | |
| 2,001,343 | 5/1935 | Fehre . | |
| 2,403,415 | 7/1946 | Van Daam . | |
| 2,555,203 | 5/1951 | Ramsey . | |
| 3,031,557 | 4/1962 | Gibbs . | |
| 3,164,921 | 1/1965 | Mavrakis . | |
| 3,288,988 | 11/1966 | Boggs . | |
| 3,667,315 | 6/1972 | Polly, Sr. . | |
| 4,343,490 | 8/1982 | Adamson . | |
| 4,440,421 | 4/1984 | Adamson . | |
| 4,471,209 | 9/1984 | Hollander | 219/204 |
| 4,598,192 | 7/1986 | Garrett | 219/201 |
| 4,640,258 | 2/1987 | Penny et al. . | |
| 4,654,970 | 4/1987 | Nagashima . | |
| 4,937,429 | 6/1990 | Hollander | 219/204 |
| 4,990,753 | 2/1991 | Hollander | 219/505 |
| 5,297,533 | 3/1994 | Cook | 124/88 |
| 5,517,786 | 5/1996 | Peissig | 43/18.1 |

*Primary Examiner*—John A. Ricci
*Attorney, Agent, or Firm*—Eugene Stephens & Associates

[57] ABSTRACT

A heater member is molded in, or otherwise appropriately form-fitted around or into, the hand grip of a bow. The heater member is energized by batteries located within a carrier in the form of an elongated container that includes, at one end, an adapter for cooperating with the stabilizer fitting of the bow. The carrier is received and supported by the bow's stabilizer fitting so that it extends with its longitudinal axis generally perpendicular to the front of the bow. At the distal end of the carrier, a weighted, removable and adjustable counterbalance element is provided. The mass and position of the counterbalance element can be varied to meet the counterbalance requirements of the archer. In a preferred embodiment, the heater member uses wire-wound or etched foil electrical resistance heating elements encased in a sheet of flexible insulator material that has a pressure-sensitive adhesive backing to facilitate attachment of the heater member to the bow's hand grip.

10 Claims, 3 Drawing Sheets

HEATED HAND GRIP FOR ARCHERY BOW

This application claims the benefit of U.S. Provisional Application No. 60/040,705, filed on Mar. 14, 1997, which provisional application is incorporated by reference herein.

TECHNICAL FIELD

This invention relates to archery bows used for shooting arrows and, more particularly, to bows designed for bow hunters.

BACKGROUND

While bow hunters use a variety of bows, including long bows and recurve bows, the majority of hunters presently use compound bows. While this invention is usable with any bow capable of being adapted to hold a stabilizer, the invention is more easily adapted to compound bows. A stabilizer is an elongated attachment, most commonly used on compound bows, which projects from the front of a bow for counterbalancing purposes. It is generally fairly massive, having an elongated cylindrical form; and it normally screws into a fitting on the front of the bow so that the longitudinal axis of the stabilizer is parallel to the shaft of an arrow appropriately positioned for release by the archer. The stabilizer tends to counterbalance and steady the bow during aiming and when the arrow is released.

In hunting seasons, bow hunters must often wait for game during long periods under cold, and sometimes wet, conditions. During such waiting, the bow's hand grip and the hunter's bow hand can become quite cold and stiff, often making it difficult to handle the bow with desired speed and accuracy.

Heated handles have long been provided for other sporting equipment such as fishing rods, ski poles, motorcycles, and snow mobiles. While archers have been provided with heated gloves [see U.S. Pat. No. 2,555,203 to Ramsey], and while bows have been provided with various types of accessories for more than 30 years, e.g., lamps [see U.S. Pat. No. 3,288,988 to Boggs] and, more recently, spot lights designed to replace stabilizers [see U.S. Pat. No. 4,640,258 to Penny et al. and U.S. Pat. No. 5,297,533 to Cook], archery bows have never been provided with heated hand grips.

SUMMARY OF THE INVENTION

The invention, which is a heated hand grip assembly for an archery bow, includes a heater member that is molded within, or otherwise appropriately form-fitted around or into, the bow's hand grip. Preferably, the heater member comprises any one of a number of well-known products in which wire-wound or etched foil electrical resistance heating elements are encased in flexible insulator materials, e.g., silicone rubber or other man-made products (for instance, those sold under the tradenames MYLAR, NEOPRENE, TEFLON, etc.). The flexible sheet of insulator material has a pressure-sensitive adhesive backing to facilitate attachment of the heater member to the bow's hand grip.

The heating elements are energized by a source of electric energy located within a carrier that forms an integral part of the heated hand grip assembly. The carrier is preferably in the form of an elongated cylindrical container that includes an adapter for cooperating with the stabilizer fitting of the bow. The carrier is received and supported by the bow's stabilizer fitting so that it extends with its longitudinal axis generally perpendicular to the front of the bow and parallel with the shaft of an arrow properly positioned in the bow's arrow guide.

In preferred embodiments, the electric energy source is one or more batteries (e.g., rechargeable nickel cadmium) located in the elongated cylindrical carrier. One end of the carrier has an adapter that fits into the bow's stabilizer fitting, and a massive counterbalance element is removably attachable to the opposite, distal end of the carrier element. The hunter can select a particular weight for this counterbalance element and, if desired, can make minor adjustments in the relative position of its center of mass to provide appropriate balance for the bow.

In one embodiment, the assembly includes a molded hand grip in which the heater elements are appropriately encased. Of course, there is no particular shape for the heated hand grip in this embodiment, since it can be contoured to meet the needs of particular hunters or the specifications of a bow manufacturer.

DRAWINGS

DETAILED DESCRIPTION

Figure 1:
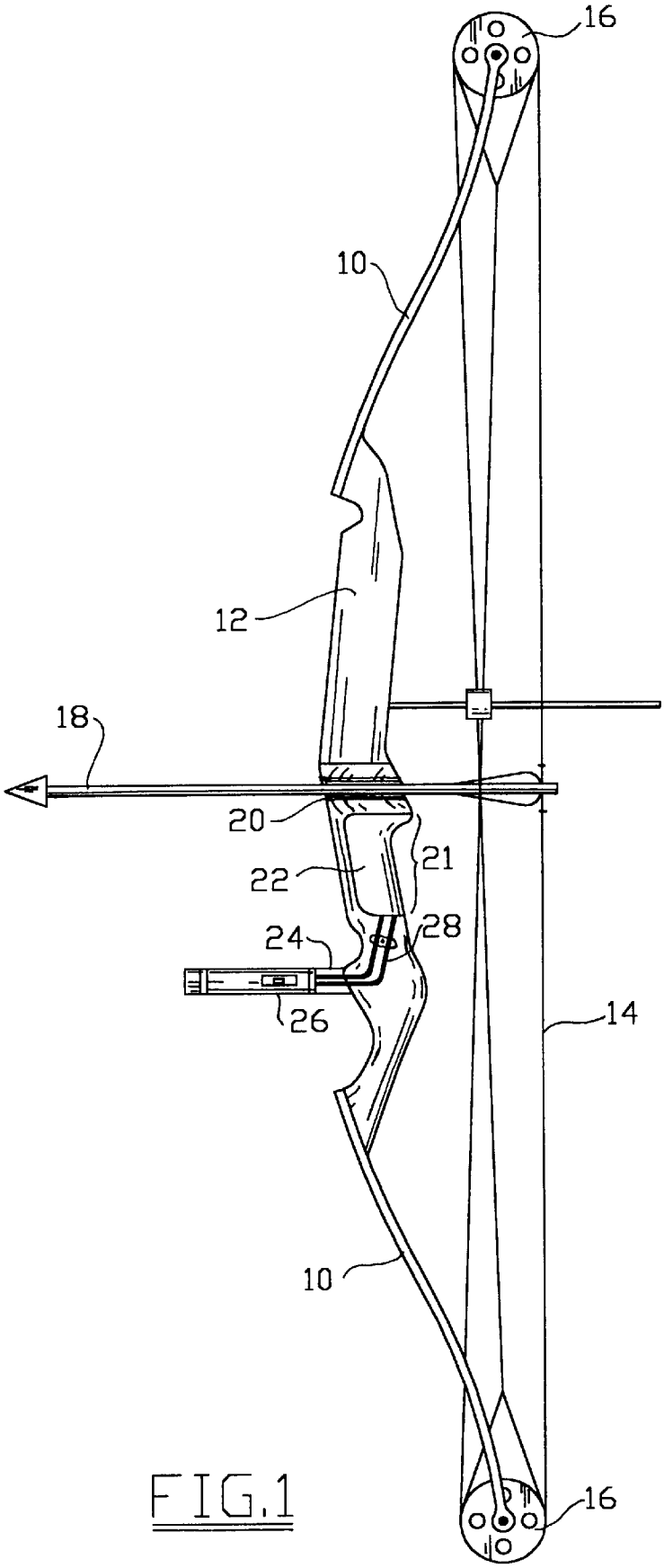
FIG. 1 is a schematic view of a conventional compound bow to which a heated handle assembly according to the invention is affixed.

A conventional compound bow, as shown in FIG. 1, has an elongated bow form in which a pair of flexible arms 10 are mounted at either end of a rigid central portion 12. A cable 14 has its ends secured to the respective distal ends of arms 10, the cable being threaded around a pair of respective pulley wheels 16 in a manner well known to users of compound bows. An arrow 18 is shown appropriately positioned in an arrow guide 20 formed in central portion 12.

Immediately below arrow guide 20, central portion 12 has a handle location 21 at which a bow handle 22 is either removably attached or integrally formed with central portion 12. At the front of central portion 12, below handle 22, a stabilizer fitting 24 receives and supports a modular stabilizer/carrier 26. In this embodiment, an electrically conductive pathway in the form of a pair of wires 28 interconnects stabilizer/carrier 26 and handle 22.

Figure 2B:
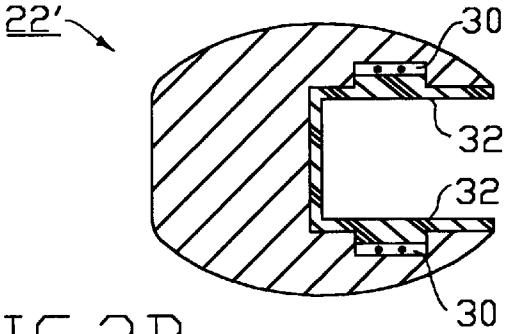
FIGS. 2A and 2B are, respectively, schematic side and cross-sectional views of the handle of the bow shown in FIG. 1, the view in FIG. 2B being taken in the plane 2B—2B shown in FIG. 2A.
Figure 2A:
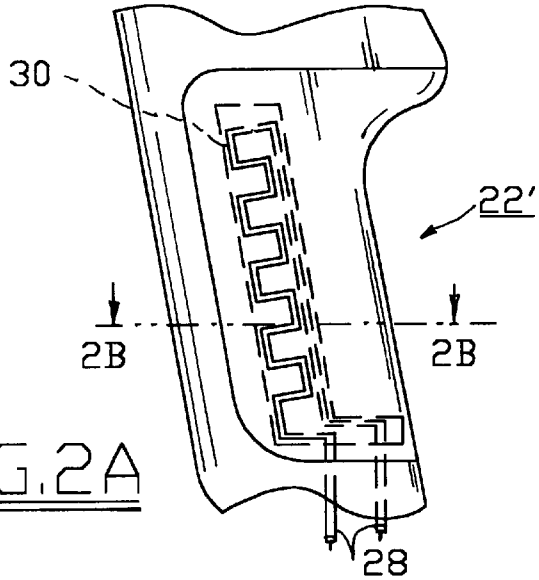

In one embodiment of the invention shown in FIGS. 2A and 2B, appropriate cavities formed in a removably attachable handle 22' receive a wire-wound or etched foil heater element 30, which is molded against the interior surface of handle 22' and covered by respective layers of insulation 32. Electrical wires 28 extend from the bottom of handle 22 and connect with heater element 30.

Figure 3:
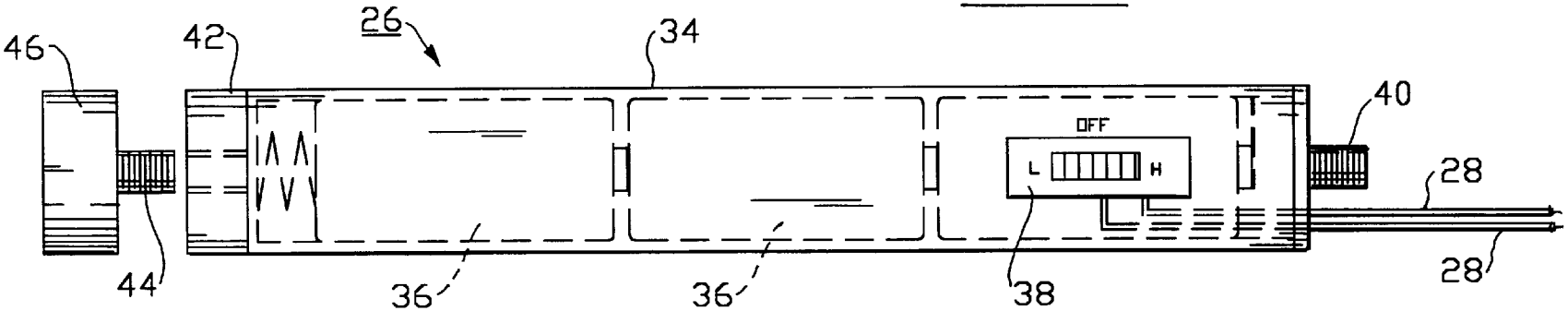
FIG. 3 is a schematic top view of the modular stabilizer/carrier of the bow shown in FIG. 1; and, for increased clarity, the stabilizer/carrier is shown removed from the bow and with its removable counterbalance element in a detached position.

Modular stabilizer/carrier 26 is shown in FIG. 3 (in larger scale than is used in FIG. 1). The central portion of carrier 26 is an elongated cylindrical container 34 which contains batteries 36 which serve as the energy source for the heater assembly. Electrical wires 28 connect to batteries 36 through a variable resistance on/off switch 38 which, in a manner well known in the electrical arts, can be selectively set to provide higher or lower levels of energy to heater element 30.

At one end of carrier 34 (at the right in FIG. 3) is an appropriate adapter 40 for cooperating with stabilizer fitting 24 which, as just explained above, is positioned at the front of central portion 12 of the bow (see FIG. 1). In the disclosed embodiment, adapter 40 is a threaded bolt, while fitting 24 is a similarly threaded receptacle.

The distal end of carrier 34 (at the left in FIG. 3) is provided with an appropriate receptor 42, e.g., another threaded receptacle, for receiving the threaded bolt 44 of a selectively removable counterbalance element 46. The weight of counterbalance element 46 is selected in accordance with the counterbalance mass required by the archer. Also, for further minor counterbalance adjustment, the exposed length of threaded bolt 44 is adjustable in counterbalance element 46 to vary the distance at which the center of mass of counterbalance element 46 is supported cantilever fashion from the front of the bow.

Figure 4C:
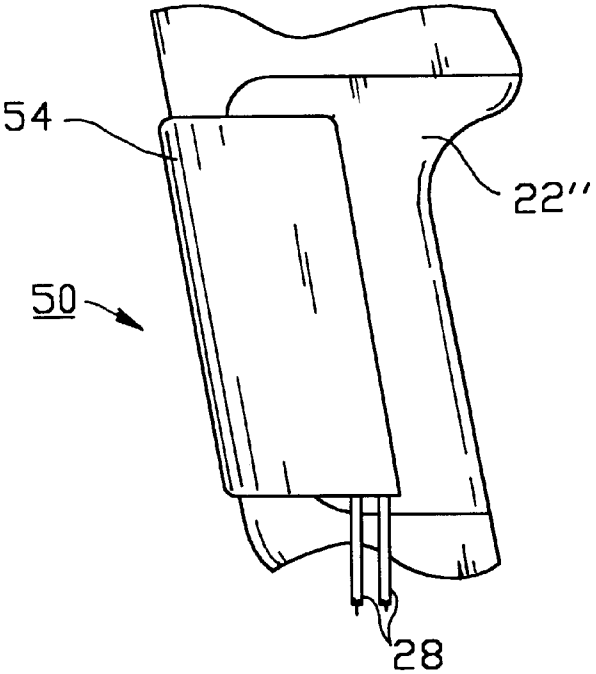
FIG. 4C is a schematic view of the same rectangular heater member when attached to the outer surface of a bow handle.
Figure 4B:
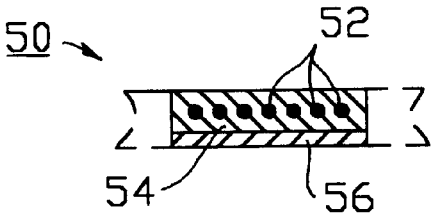
FIG. 4B is a very schematic cross-sectional view of the rectangular heater member in FIG. 4A.
Figure 4A:
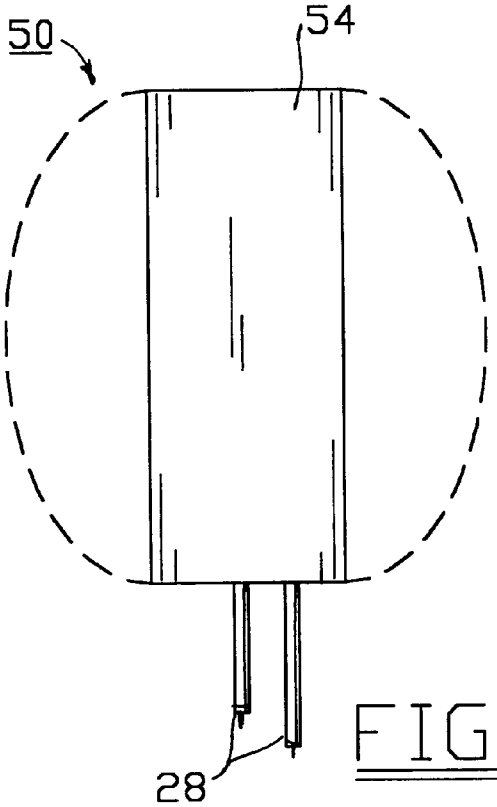
FIG. 4A is a schematic view of a rectangular heater member (with possible additional extensions shown in dotted lines)

FIGS. 4A and 4B illustrate, respectively, very schematic top and cross-sectional views of the preferred form for a heater member 50 for my heated hand grip assembly. Heater element 50 uses electrical resistance heating elements 52 (in the well-known form of either wires or etched foil) encased in a thin sheet of flexible insulator material 54 as discussed above. Electrical current is delivered through wires 28 to heating elements 52.

Heater element 50 also has a pressure-sensitive adhesive backing 56 to facilitate attachment of heater member 50 to the bow's hand grip. An example of such adhesive attachment is illustrated in FIG. 4C which shows heater member 50 wrapped around and press-fitted against the front exterior surfaces of a hand grip 22" which may be either removably attached to, or integrally formed with, central portion 12 (see FIG. 1) of the bow.

With the assembly just described, the archer can energize heated handle 22 whenever needed and can select higher or lower. heat according to prevailing conditions. Further, my heated handle assembly does not intrude in any way upon normal operation of the bow nor does its addition to a bow visibly affect the bow's conventional configuration and aesthetics.

I claim:

1. A heated hand grip assembly for an archery bow having an elongated form with a pair of flexible arms mounted at either end of a rigid central portion that includes an arrow guide, a hand grip location below said guide, and a stabilizer fitting positioned below said hand grip location for receiving and supporting a stabilizer member so that said stabilizer member extends from the front of said central portion, said heated hand grip assembly comprising:

a heater member for attachment to said bow in the vicinity of said hand grip location;

a carrier having an adapter for cooperating with said stabilizer fitting, said carrier being received and supported by said stabilizer fitting;

a source of electric energy positioned within said carrier; and a conductive pathway for connecting said heater member to said source of electric energy.

2. The heated hand grip assembly of claim 1 wherein:

said carrier comprises an elongated container having a longitudinal axis; and when said carrier is supported in said stabilizer fitting, said longitudinal axis extends perpendicular to the front of said central portion.

3. The heated hand grip assembly of claim 2 wherein said carrier further comprises:

an inner end, to which said adapter is fixed, and a distal end; and a removable counterbalance element releasably connected to said distal end to add mass to said container.

4. The heated hand grip assembly of claim 1 further comprising a hand grip positioned at said hand grip location of said bow, and wherein said heater member is one of (a) imbedded within and (b) form-fitted around said hand grip.

5. The heated hand grip assembly of claim 4 wherein said hand grip is removably attached to said hand grip location of said bow.

6. The heated hand grip assembly of claim 1 wherein said heater member comprises a flexible sheet of insulator material in which electrical resistance heating elements are encased.

7. The heated hand grip assembly of claim 6 wherein said bow has a hand grip positioned in said hand grip location and said flexible sheet of insulator material has a pressure-sensitive adhesive backing to facilitate attachment of said heater member to said hand grip.

8. An archery bow comprising:

a pair of flexible elongated arms, each mounted at a respective opposite end of a rigid central portion having (a) an arrow guide, (b) a hand grip location below said guide, and (c) a stabilizer fitting positioned below said hand grip location;

a heater member fitted to said hand grip location;

a carrier;

a source of electric energy located within said carrier; and a conductive pathway for connecting said heater member to said source of electric energy.

9. The bow of claim 8 wherein said carrier further comprises an adapter for cooperating with said stabilizer fitting, said carrier being received and supported by said stabilizer fitting and extending from the front of said central portion.

10. The bow of claim 8 wherein said carrier further comprises a removable counterbalance element.

* * * * *